US009402145B2

(12) United States Patent
Carlsson et al.

(10) Patent No.: US 9,402,145 B2
(45) Date of Patent: Jul. 26, 2016

(54) WIRELESS SPEAKER SYSTEM WITH DISTRIBUTED LOW (BASS) FREQUENCY

(71) Applicant: SONY CORPORATION, Tokyo (JP)

(72) Inventors: Gregory Peter Carlsson, Santee, CA (US); Frederick J. Zustak, Poway, CA (US); Steven Martin Richman, San Diego, CA (US); James R. Milne, Ramona, CA (US)

(73) Assignee: Sony Corporation, Tokyo (JP)

( * ) Notice: Subject to any disclaimer, the term of this patent is extended or adjusted under 35 U.S.C. 154(b) by 149 days.

(21) Appl. No.: 14/163,213

(22) Filed: Jan. 24, 2014

(65) Prior Publication Data

US 2015/0215723 A1 Jul. 30, 2015

(51) Int. Cl.

| | |
|---|---|
| ***H04R 25/00*** | (2006.01) |
| ***H04S 7/00*** | (2006.01) |
| *H04R 5/00* | (2006.01) |

(52) U.S. Cl.

CPC ..... *H04S 7/307* (2013.01); *H04S 7/301* (2013.01); *H04S 2400/07* (2013.01)

(58) Field of Classification Search

CPC ..... H04N 21/43615; H04N 21/43637; H04R 2227/005; H04R 27/00; H04R 2420/01; H04R 2420/07; H04R 3/12; H04R 5/04; H04R 1/2819; H04R 1/2826; H04R 2205/024; H04R 2205/026; H04R 2420/05; H04R 3/00; H04R 5/02; H03G 5/165; H04S 3/00; H04S 2400/07; H04S 7/307; H04S 7/308; H04W 60/00; H04W 8/005; H04W 84/10; G06F 17/3074; G06F 3/16

USPC ..... 381/103, 17, 18, 300, 61, 80, 81, 9; 700/94

See application file for complete search history.

(56) References Cited

U.S. PATENT DOCUMENTS

| | | | | |
|---|---|---|---|---|
| 7,085,387 | B1 | 8/2006 | Metcalf | |
| 7,191,023 | B2 | 3/2007 | Williams | |
| 7,792,311 | B1 * | 9/2010 | Holmgren et al. | 381/61 |
| 7,853,022 | B2 | 12/2010 | Thompson et al. | |
| 8,077,873 | B2 | 12/2011 | Shridhar et al. | |
| 8,179,755 | B2 | 5/2012 | Harris | |
| 8,199,941 | B2 | 6/2012 | Hudson et al. | |
| 8,218,789 | B2 | 7/2012 | Bharitkar et al. | |
| 8,436,758 | B2 | 5/2013 | McLaughlin et al. | |
| 8,437,432 | B2 | 5/2013 | McLaughlin et al. | |
| 8,509,463 | B2 | 8/2013 | Goh et al. | |
| 8,553,898 | B2 | 10/2013 | Raftery | |

(Continued)

FOREIGN PATENT DOCUMENTS

| | | | |
|---|---|---|---|
| JP | 2011004077 | A | 1/2011 |
| WO | 2009002292 | A1 | 12/2008 |

OTHER PUBLICATIONS

Gregory Peter Carlsson, Steven Martin Richman, James R. Milne, "Distributed Wireless Speakers System", file history of related pending U.S. Appl. No. 14/158,396 filed Jan. 17, 2014.

(Continued)

*Primary Examiner* — Paul S Kim
*Assistant Examiner* — Norman Yu
(74) *Attorney, Agent, or Firm* — John L. Rogitz

(57) ABSTRACT

A speaker system comprised of more than one speaker, which utilizes the known characteristics and location of each speaker to enhance low frequency (low (bass) frequency) performance of the system.

17 Claims, 10 Drawing Sheets

(56) References Cited

U.S. PATENT DOCUMENTS

| | | | | |
|---|---|---|---|---|
| 8,677,224 | B2 | 3/2014 | McLaughlin et al. | |
| 8,760,334 | B2 | 6/2014 | McLaughlin et al. | |
| 8,811,630 | B2 | 8/2014 | Burlingame | |
| 9,054,790 | B2 | 6/2015 | McLaughlin et al. | |
| 9,161,111 | B2 | 10/2015 | Yuan et al. | |
| 2004/0030425 | A1 | 2/2004 | Yeakel et al. | |
| 2004/0196140 | A1 | 10/2004 | Sid | |
| 2006/0106620 | A1 | 5/2006 | Thompson et al. | |
| 2006/0285697 | A1 | 12/2006 | Nishikawa et al. | |
| 2007/0297519 | A1 | 12/2007 | Thompson et al. | |
| 2008/0141316 | A1* | 6/2008 | Igoe et al. | 725/81 |
| 2008/0175397 | A1* | 7/2008 | Holman | 381/55 |
| 2008/0279307 | A1 | 11/2008 | Gaffney et al. | |
| 2008/0279453 | A1 | 11/2008 | Candelore | |
| 2008/0304677 | A1 | 12/2008 | Abolfathi et al. | |
| 2009/0060204 | A1 | 3/2009 | Reams et al. | |
| 2010/0220864 | A1 | 9/2010 | Martin et al. | |
| 2011/0270428 | A1 | 11/2011 | Tam | |
| 2012/0014524 | A1 | 1/2012 | Vafiadis | |
| 2012/0058727 | A1 | 3/2012 | Cook et al. | |
| 2012/0069868 | A1 | 3/2012 | McLaughlin et al. | |
| 2012/0114151 | A1 | 5/2012 | Nguyen et al. | |
| 2012/0120874 | A1 | 5/2012 | McLaughlin et al. | |
| 2013/0039514 | A1 | 2/2013 | Knowles et al. | |
| 2013/0051572 | A1 | 2/2013 | Goh et al. | |
| 2013/0156212 | A1 | 6/2013 | Bjelosevic et al. | |
| 2013/0272535 | A1 | 10/2013 | Yuan et al. | |
| 2013/0305152 | A1 | 11/2013 | Griffiths et al. | |
| 2014/0003623 | A1* | 1/2014 | Lang | 381/98 |
| 2014/0003625 | A1* | 1/2014 | Sheen et al. | 381/103 |
| 2014/0219483 | A1 | 8/2014 | Hong | |
| 2014/0362995 | A1 | 12/2014 | Backman et al. | |
| 2015/0201295 | A1 | 7/2015 | Lau et al. | |
| 2015/0208187 | A1 | 7/2015 | Carlsson et al. | |
| 2015/0208190 | A1 | 7/2015 | Hooks et al. | |
| 2015/0228262 | A1 | 8/2015 | Silfvast et al. | |
| 2015/0271620 | A1 | 9/2015 | Lando et al. | |
| 2015/0341737 | A1 | 11/2015 | Kallai et al. | |
| 2015/0350804 | A1 | 12/2015 | Crockett et al. | |
| 2015/0358707 | A1 | 12/2015 | Saijo et al. | |

OTHER PUBLICATIONS

Gregory Peter Carlsson, Steven Martin Richman, James R. Milne, "Distributed Wireless Speaker System with Automatic Configuration Determination When New Speakers Are Added", file history of related pending U.S. Appl. No. 14/159,155 filed Jan. 20, 2014.

James R. Milne, Gregory Peter Carlsson, Steven Martin Richman, Frederick J. Zustak, "Audio Speaker System with Virtual Music Performance", File History of related pending U.S. Appl. No. 14/163,415 'lied Jan. 24, 2014.

Gregory Peter Carlsson, Frederick J. Zustak, Steven Martin Richman, James R. Milne, "Wireless Speaker System with Noise Cancelation", File History of related pending U.S. Appl. No. 14/163,089 filed Jan. 24, 2014.

Gregory Peter Carlsson, James R. Milne, Steven Martin Richman, Frederick J. Zustak, "Distributed Wireless Speaker System with Light Show", file history of related pending U.S. Appl. No. 14/163,542 filed Jan. 24, 2014.

Gregory Peter Carlsson, Keith Resch, Oscar Manuel Vega, "Networked Speaker System with Follow Me", file history of related allowed U.S. Appl. No. 14/199,137 filed Mar. 6, 2014.

Robert W. Reams, "N-Channel Rendering: Workable 3-D Audio for 4kTV", AES 135, New York City, 2013.

James R. Milne, Gregory Peter Carlsson, Steven Martin Richman, Frederick J. Zustak, "Audio Speaker System With Virtual Music Performance", related U.S. Appl. No. 14/163,415, Final Office Action dated Feb. 25, 2016.

Gregory Peter Carlsson, James R. Milne, Martin Richman, Frederick J. Zustak "Distributed Wireless Speaker System with Light Show", related U.S. Appl. No. 14/163,542, Non-Final Office Action dated Feb. 24, 2016.

Gregory Peter Carlsson, Keith Resch, Oscar Manuel Vega, "Networked Speaker System with Follow Me", File history of related U.S. Appl. No. 14/974,413 filed Dec. 18, 2015.

James R. Milne, Gregory Carlsson, "Centralized Wireles.s Speaker System", file history of related U.S. Appl. No. 15/019,111 filed Feb. 9, 2016.

James R. Milne. Gregory Carlsson, "Distributed Wireless Speaker System", file history of related U.S. Appl. No. 15/044,920 filed Feb. 16, 2016.

James R. Milne, Gregory Carlsson, Steven Richman, Frederick Zustak, "Wireless Speaker System". file history of related U.S. Appl. No. 15/044,981 filed Feb. 16, 2016.

James R. Milne, Gregory Peter Carlsson, Steven Martin Richman, Frederick J. Zustak, "Audio Speaker System with Virtual Music Performance", related U.S. Appl. No. 14/163,415, Final Office Action dated Mar. 16, 2016.

* cited by examiner

Networked-Speaker Block Diagram

Networked-Speaker System Speaker Locations

Networked-Speaker System Speaker Locations

WIRELESS SPEAKER SYSTEM WITH DISTRIBUTED LOW (BASS) FREQUENCY

I. FIELD OF THE INVENTION

The present application relates generally to wireless speaker systems with distributed low (bass) frequencies.

II. BACKGROUND OF THE INVENTION

People who enjoy high quality sound, for example in home entertainment systems, prefer to use multiple speakers for providing stereo, surround sound, and other high fidelity sound. As understood herein, optimizing speaker settings for the particular room and speaker location in that room does not lend itself to easy accomplishment by non-technical users, who moreover can complicate initially established settings by moving speakers around.

Of particular focus herein is the limited low-frequency reproduction capability of most home audio speakers particularly in the low (bass) frequency range, and limited home audio user knowledge of effective speaker placements and room acoustics. As understood herein, low (bass) frequency sound can be provided by distributing low (bass) frequencies to multiple, separately-addressable networked speakers.

SUMMARY OF THE INVENTION

Present principles provide a networked speaker system that uses known characteristics of a speaker system and the known location of the speakers within a room to apply one or more techniques to produce low (bass) frequencies as may be carried in, e.g., a low frequency effect (LFE) channel in Dolby systems.

Accordingly, a device includes at least one computer readable storage medium bearing instructions executable by a processor, and at least one processor configured for accessing the computer readable storage medium to execute the instructions to configure the processor for accessing characteristics of plural speakers having respective locations within a space. The processor when accessing the medium is also configured for modeling multiple speaker configurations, determining whether a modeled speaker configuration satisfies at least one low (bass) frequency criterion, and establishing the modeled speaker configuration at least in part by automatically setting speaker parameters including identifying individual speakers using respective network addresses. Alternatively or in addition, the processor when accessing the instructions is configured for establishing the modeled speaker configuration at least in part by outputting a suggested configuration to a user. The suggested configuration includes at least one suggested speaker location.

In example embodiments the modeled speaker configuration is established by the processor when executing the instructions at least in part by automatically setting speaker parameters. The speaker parameters may include equalization. In example implementations the modeled speaker configuration is established by the processor when executing the instructions at least in part by outputting a suggested configuration to a user.

In some embodiments, the processor when executing the instructions can be further configured for modeling plural equalizations of at least a first speaker to model respective boosts of an output of the first speaker at a frequency corresponding to a minimum cone excursion of the first speaker. If desired, the processor when executing the instructions is further configured for, responsive to a determination that no modeled speaker equalization combination satisfies the at least one low (bass) frequency criterion, modeling plural candidate speaker locations in the space, and otherwise not modeling plural candidate speaker locations in the space. The processor when executing the instructions may be further configured for receiving at least one test signal from at least one measurement microphone, and using the test signal to determine a modeled speaker configuration.

In another aspect, a method includes accessing characteristics of a multi-speaker system, and modeling multiple speaker configurations of the system. The method also includes determining whether a modeled speaker configuration satisfies at least one low (bass) frequency criterion, and establishing the modeled speaker configuration at least in part responsive to a determination that the modeled speaker configuration satisfies the at least one low (bass) frequency criterion.

In another aspect, a system includes at least one computer readable storage medium bearing instructions executable by a processor which is configured for accessing the computer readable storage medium to execute the instructions to configure the processor for controlling a speaker system comprised of more than one speaker. The instructions also configure the processor for using characteristics and locations of each speaker to enhance low (bass) frequency performance of the system at least in part by distributing low (bass) frequencies among plural speakers.

The details of the present application, both as to its structure and operation, can be best understood in reference to the accompanying drawings, in which like reference numerals refer to like parts, and in which:

DETAILED DESCRIPTION OF THE PREFERRED EMBODIMENT

Figure 1:
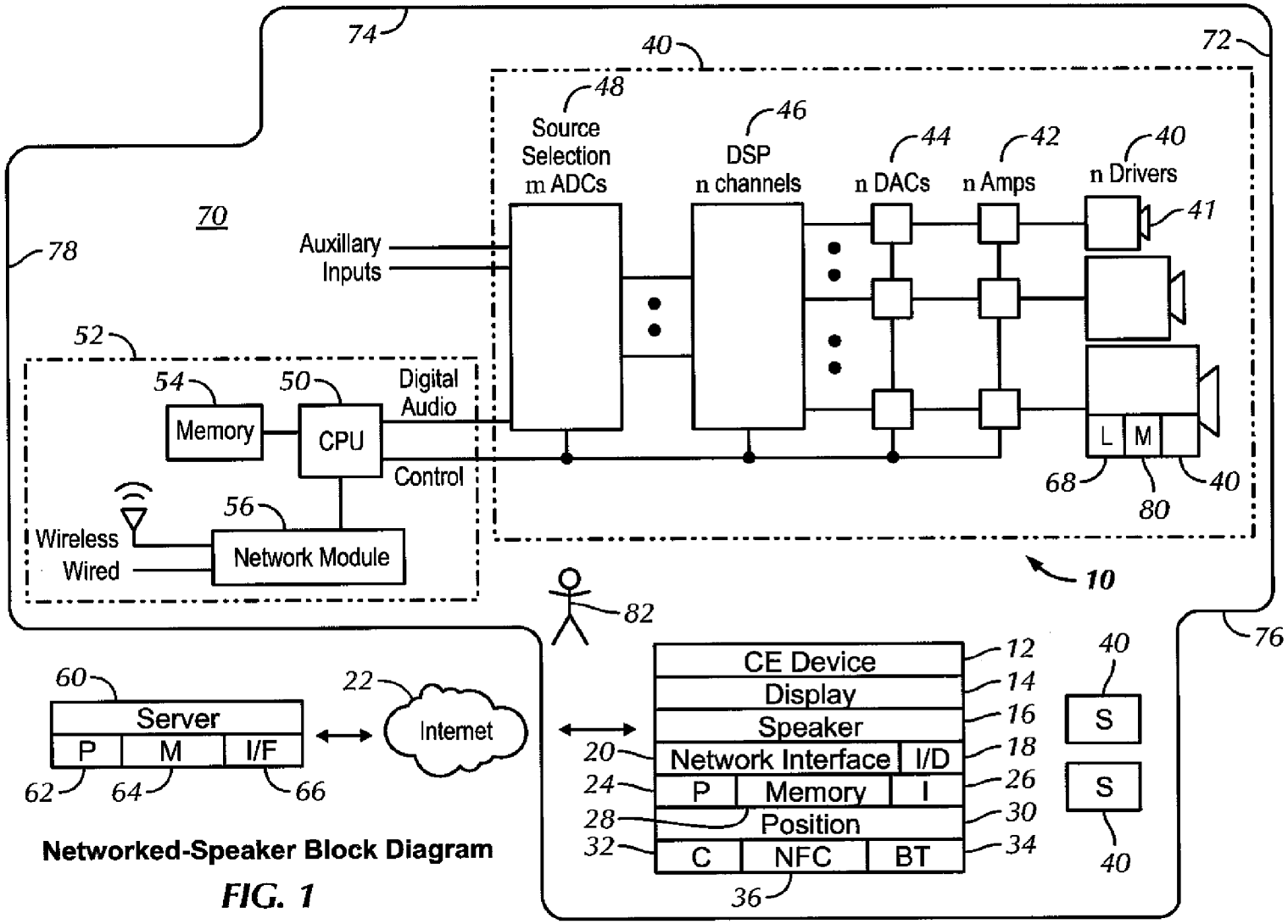
FIG. 1 is a block diagram of an example system including an example in accordance with present principles.

This disclosure relates generally to computer ecosystems including aspects of multiple audio speaker ecosystems. A system herein may include server and client components, connected over a network such that data may be exchanged between the client and server components. The client components may include one or more computing devices that have audio speakers including audio speaker assemblies per se but also including speaker-bearing devices such as portable televisions (e.g. smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers may include one or more processors executing instructions that configure the servers to receive and transmit data over a network such as the Internet. Or, a client and server can be connected over a local intranet or a virtual private network.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be any conventional general purpose single- or multi-chip processor that can execute logic by means of various lines such as address lines, data lines, and control lines and registers and shift registers. A processor may be implemented by a digital signal processor (DSP), for example.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and digital subscriber line (DSL) and twisted pair wires. Such connections may include wireless communication connections including infrared and radio.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is an example consumer electronics (CE) device 12. The CE device 12 may be, e.g., a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, etc., and even e.g. a computerized Internet-enabled television (TV). Regardless, it is to be understood that the CE device 12 is configured to undertake present principles (e.g. communicate with other devices to undertake present principles, execute the logic described herein, and perform any other functions and/or operations described herein).

Accordingly, to undertake such principles the CE device 12 can be established by some or all of the components shown in FIG. 1. For example, the CE device 12 can include one or more touch-enabled displays 14, one or more speakers 16 for outputting audio in accordance with present principles, and at least one additional input device 18 such as e.g. an audio receiver/microphone for e.g. entering audible commands to the CE device 12 to control the CE device 12. The example CE device 12 may also include one or more network interfaces 20 for communication over at least one network 22 such as the Internet, an WAN, an LAN, etc. under control of one or more processors 24. It is to be understood that the processor 24 controls the CE device 12 to undertake present principles, including the other elements of the CE device 12 described herein such as e.g. controlling the display 14 to present images thereon and receiving input therefrom. Furthermore, note the network interface 20 may be, e.g., a wired or wireless modem or router, or other appropriate interface such as, e.g., a wireless telephony transceiver, WiFi transceiver, etc.

In addition to the foregoing, the CE device 12 may also include one or more input ports 26 such as, e.g., a USB port to physically connect (e.g. using a wired connection) to another CE device and/or a headphone port to connect headphones to the CE device 12 for presentation of audio from the CE device 12 to a user through the headphones. The CE device 12 may further include one or more tangible computer readable storage medium or memory 28 such as disk-based or solid state storage. Also in some embodiments, the CE device 12 can include a position or location receiver such as but not limited to a GPS receiver and/or altimeter 30 that is configured to e.g. receive geographic position information from at least one satellite and provide the information to the processor 24 and/or determine an altitude at which the CE device 12 is disposed in conjunction with the processor 24. However, it is to be understood that that another suitable position receiver other than a GPS receiver and/or altimeter may be used in accordance with present principles to e.g. determine the location of the CE device 12 in e.g. all three dimensions.

Continuing the description of the CE device 12, in some embodiments the CE device 12 may include one or more cameras 32 that may be, e.g., a thermal imaging camera, a digital camera such as a webcam, and/or a camera integrated into the CE device 12 and controllable by the processor 24 to gather pictures/images and/or video in accordance with present principles. Also included on the CE device 12 may be a Bluetooth transceiver 34 and other Near Field Communication (NFC) element 36 for communication with other devices using Bluetooth and/or NFC technology, respectively. An example NFC element can be a radio frequency identification (RFID) element.

Further still, the CE device 12 may include one or more motion sensors (e.g., an accelerometer, gyroscope, cyclometer, magnetic sensor, infrared (IR) motion sensors such as passive IR sensors, an optical sensor, a speed and/or cadence sensor, a gesture sensor (e.g. for sensing gesture command), etc.) providing input to the processor 24. The CE device 12 may include still other sensors such as e.g. one or more climate sensors (e.g. barometers, humidity sensors, wind sensors, light sensors, temperature sensors, etc.) and/or one or more biometric sensors providing input to the processor 24. In addition to the foregoing, it is noted that in some embodiments the CE device 12 may also include a kinetic energy harvester to e.g. charge a battery (not shown) powering the CE device 12.

In some examples the CE device 12 is used to control multiple ("n", wherein "n" is an integer greater than one) speakers 40, each of which receives signals from a respective amplifier 42 over wired and/or wireless links to transduce the signal into sound. Each amplifier 42 may receive over wired and/or wireless links an analog signal that has been converted from a digital signal by a respective standalone or integral (with the amplifier) digital to analog converter (DAC) 44. The DACs 44 may receive, over respective wired and/or wireless channels, digital signals from a digital signal processor (DSP) 46 or other processing circuit. The DSP 46 may receive source selection signals over wired and/or wireless links from plural analog to digital converters (ADC) 48, which may in turn receive appropriate auxiliary signals and, from a control processor 50 of a control device 52, digital audio signals over wired and/or wireless links. The control processor 50 may access a computer memory 54 such as any of those described above and may also access a network module 56 to permit wired and/or wireless communication with, e.g., the Internet. As shown in FIG. 1, the control processor 50 may also communicate with each of the ADCs 48, DSP 46, DACs 44, and amplifiers 42 over wired and/or wireless links. The control device 52, while being shown separately from the CE device 12, may be implemented by the CE device 12. In some embodiments the CE device 12 is the control device and the CPU 50 and memory 54 are distributed in each individual speaker as individual speaker processing units. In any case, each speaker 40 can be separately addressed over a network from the other speakers.

More particularly, in some embodiments, each speaker 40 may be associated with a respective network address such as but not limited to a respective media access control (MAC) address. Thus, each speaker may be separately addressed over a network such as the Internet. Wired and/or wireless communication links may be established between the speakers 40/CPU 50, CE device 12, and server 60, with the CE device 12 and/or server 60 being thus able to address individual speakers, in some examples through the CPU 50 and/or through the DSP 46 and/or through individual processing units associated with each individual speaker 40, as may be mounted integrally in the same housing as each individual speaker 40. Thus, as alluded to above, the CPU 50 may be distributed in individual processing units in each speaker 40.

The CE device 12 and/or control device 52 (when separate from the CE device 12) and/or individual speaker trains (speaker+amplifier+DAC+DSP, for instance) may communicate over wired and/or wireless links with the Internet 22 and through the Internet 22 with one or more network servers 60. Only a single server 60 is shown in FIG. 1. A server 60 may include at least one processor 62, at least one tangible computer readable storage medium 64 such as disk-based or solid state storage, and at least one network interface 66 that, under control of the processor 62, allows for communication with the other devices of FIG. 1 over the network 22, and indeed may facilitate communication between servers and client devices in accordance with present principles. Note that the network interface 66 may be, e.g., a wired or wireless modem or router, WiFi transceiver, or other appropriate interface such as, e.g., a wireless telephony transceiver, Accordingly, in some embodiments the server 60 may be an Internet server, may include and perform "cloud" functions such that the devices of the system 10 may access a "cloud" environment via the server 60 in example embodiments. In a specific example, the server 60 downloads a software application to the CE device 12 for control of the speakers 40 according to logic below. The CE device 12 in turn can receive certain information from the speakers 40, such as their GPS location, and/or the CE device 12 can receive input from the user, e.g., indicating the locations of the speakers 40 as further disclosed below. Based on these inputs at least in part, the CE device 12 may execute the speaker optimization logic discussed below, or it may upload the inputs to a cloud server 60 for processing of the optimization algorithms and return of optimization outputs to the CE device 12 for presentation thereof on the CE device 12, and/or the cloud server 60 may establish speaker configurations automatically by directly communicating with the speakers 40 via their respective addresses, in some cases through the CE device 12. Note that if desired, each speaker 40 may include a respective one or more lamps 68 that can be illuminated on the speaker.

Typically, the speakers 40 are disposed in an enclosure 70 such as a room, e.g., a living room. Note that each speaker or a group of speakers may themselves be located in a speaker enclosure with the room enclosure 70. For purposes of disclosure, the enclosure 70 has (with respect to the example orientation of the speakers shown in FIG. 1) a front wall 72, left and right side walls 74, 76, and a rear wall 78. One or more listeners 82 may occupy the enclosure 70 to listen to audio from the speakers 40. One or microphones 80 may be arranged in the enclosure for measuring signals representative of sound in the enclosure 70, sending those signals via wired and/or wireless links to the CPU 50 and/or the CE device 12 and/or the server 60. In the non-limiting example shown, each speaker 40 supports a microphone 80, it being understood that the one or more microphones may be arranged elsewhere in the system if desired.

Disclosure below may refer to establishing speaker locations and other configuration parameters based on certain desired audio performances or other similar determinations. It is to be understood that such determinations may be made using sonic wave calculations known in the art, in which the acoustic waves frequencies (and their harmonics) from each speaker, given its frequency assignation, are computationally modeled in the enclosure 70 and the locations of constructive and destructive wave interference determined based on where the speaker is and where the walls 72-78 are. As mentioned above, the computations may be executed, e.g., by the CE device 12 and/or by the cloud server 60, with results of the computations being returned to the CE device 12 for presentation thereof and/or used to automatically establish parameters of the speakers.

As an example, a speaker may emit a band of frequencies between 20 Hz and 30 kHz, and frequencies (with their harmonics) of 20 Hz, 25 Hz, and 30 Hz may be modeled to propagate in the enclosure 70 with constructive and destructive interference locations noted and recorded. Other frequencies also can be modeled, e.g., 20-200 Hz frequencies, with harmonics if desired. The wave interference patterns of other speakers based on the modeled expected frequency assignations and the locations in the enclosure 70 of those other speakers may be similarly computationally modeled together to render an acoustic model for a particular speaker system physical layout in the enclosure 70 with a particular speaker frequency assignations. In some embodiments, reflection of sound waves from one or more of the walls 72-78 may be accounted for in determining wave interference. In other embodiments reflection of sound waves from one or more of the walls 72-78 may not be accounted for in determining wave interference. The acoustic model based on wave interference computations may furthermore account for particular speaker parameters such as but not limited to equalization (EQ). The parameters may also include delays, i.e., sound track delays between speakers, which result in respective wave propagation delays relative to the waves from other speakers, which delays may also be accounted for in the modeling. A sound track delay refers to the temporal delay between emitting, using respective speakers, parallel parts of the same soundtrack, which temporally shifts the waveform pattern of the corresponding speaker. The parameters can also include volume, which defines the amplitude of the waves from a particular speaker and thus the magnitude of constructive and destructive interferences in the waveform. Collectively, a combination of speaker location, frequency assignation, and parameters may be considered to be a "configuration".

Each variable (speaker location, frequency assignation, and individual parameters) may then be computationally varied as the other variables remain static to render a different configuration having a different acoustic model. For example, one model may be generated for the speakers of a system being in respective first locations, and then a second model computed by assuming that at least one of the speakers has been moved to a second location different from its first location, and each such computation may be repeated for various frequency assignations and speaker parameter(s) to render a set of computations for multiple permutations and combinations of speaker location/frequency assignation/parameter. Similarly, a first model may be generated for speakers of a system having a first set of frequency assignations, and then a second model may be computed by assuming that at least one of the speakers has been assigned a second frequency band to transmit different from its first frequency assignation. Yet again, if one speaker location/frequency assignation combination is evaluated as presenting a poor configuration, the model may introduce, speaker by speaker, a series of incremental delays, reevaluating the acoustic model for each delay increment, until a particular set of delays to render the particular speaker location/frequency assignation combination acceptable is determined. Acoustic models for any number of speaker location/frequency assignation/speaker parameter (i.e., for any number of configurations) may be calculated in this way.

Each acoustic model may then be evaluated based at least in part on the locations and/or magnitudes of the constructive and destructive interferences in that model to render one or more of the determinations/recommendations below. The evaluations may be based on heuristically-defined rules. Non-limiting examples of such rules may be that a particular configuration is evaluated as "good" if low (bass) frequency resonance is below a threshold amplitude at a particular location, e.g., at an assumed (modeled) viewer 82 location. Another rule may be that a particular configuration is evaluated as "good" if low (bass) frequency resonance is above a threshold amplitude at a particular location, e.g., at an assumed (modeled) viewer 82 location, and otherwise is evaluated as "bad". Another rule may be that a particular configuration is evaluated as "good" if the total (summed) amplitudes of all constructive interference points in the enclosure 70 exceed a threshold amplitude. Another rule may be that a particular configuration is evaluated as "good" if the total (summed) amplitudes of all constructive interference points in the enclosure 70 are below a threshold amplitude. Another rule may be that a particular configuration is evaluated as "good" if the total (summed) amplitudes of all destructive interference points in the enclosure 70 exceed a threshold number (e.g., for noise cancellation). Another rule may be that a particular configuration is evaluated as "good" if the total (summed) amplitudes of all destructive interference points in the enclosure 70 are below a threshold number. Another rule may that the "best" speaker configuration is the one producing the largest area of mean constructive wave interference. Another rule may be to decrease the volume output by a bass speaker (woofer or low (bass) frequency) if the distance between the speaker and a wall of the enclosure 70 is within a threshold distance. Another rule may be that a speaker configuration is "good" if constructive interference in a user-defined frequency range at a default or user-defined listener location in the enclosure 70 is above a threshold.

Plural rules may be applied, with the number of "good" evaluations for a particular configuration under the plural rules being summed together and, if desired, with any "bad" evaluations for that configuration under other rules being deducted from the sum, to render a score. The configuration with the highest score may be considered the "best" configuration. Or, each "good" evaluation may be accorded a number other than one and the scores may be combined by multiplication or division and compared to a threshold that is established accordingly. In addition to multiplication/division and addition/subtraction, the scores may be combined in other ways, e.g., exponentially (as exponents in terms of an equation, for instance), trigonometrically (as coefficients or angles in sinusoidal equations, for instance), etc., with the comparison values established as appropriate for the particular mathematical manner in which the scores are combined. It is to be understood that the heuristic rules above are illustrative only and are not otherwise limiting. It is to be further understood that evaluation rules may be user-selected or user-generated.

The location of the walls 72-78 may be input by the user using, e.g., a user interface (UI) in which the user may draw, as with a finger or stylus on a touch screen display 14 of a CE device 12, the walls 72-78 and locations of the speakers 40. Or, the position of the walls may be measured by emitting chirps, including a frequency sweep, in sequence from each of the speakers 40 as detected by each of the microphones 80 and/or from the microphone 18 of the CE device 12, determining, using the formula distance=speed of sound multiplied by time until an echo is received back, the distance between the emitting microphone and the walls returning the echoes. Note in this embodiment the location of each speaker (inferred to be the same location as the associated microphone) is known as described above. By computationally modeling each measured wall position with the known speaker locations, the contour of the enclosure 70 can be approximately mapped.

Figure 2:
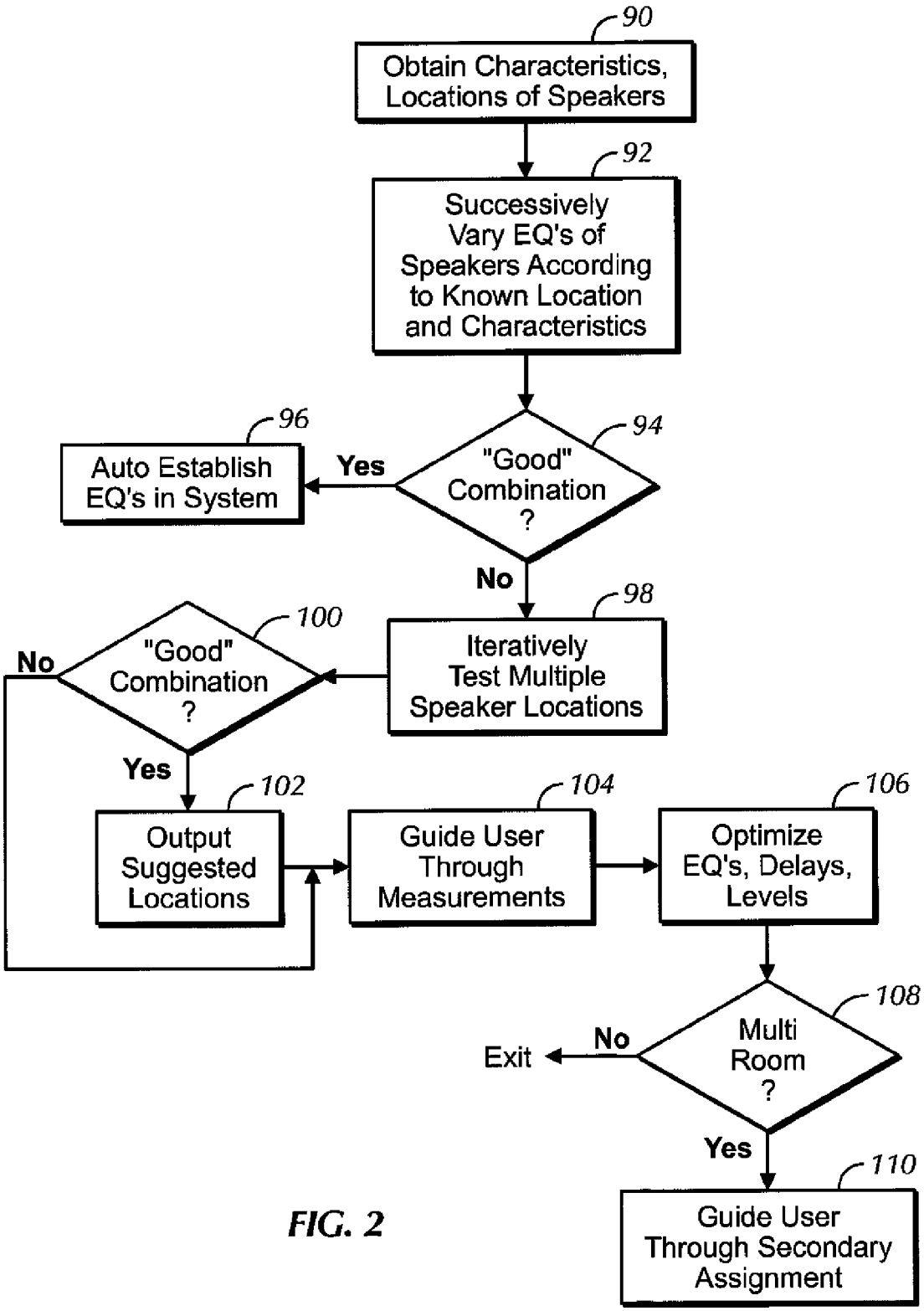
FIGS. 2, 2A, 2B, 3, 3A are flow charts of example logic according to present principles.
Figure 2A:
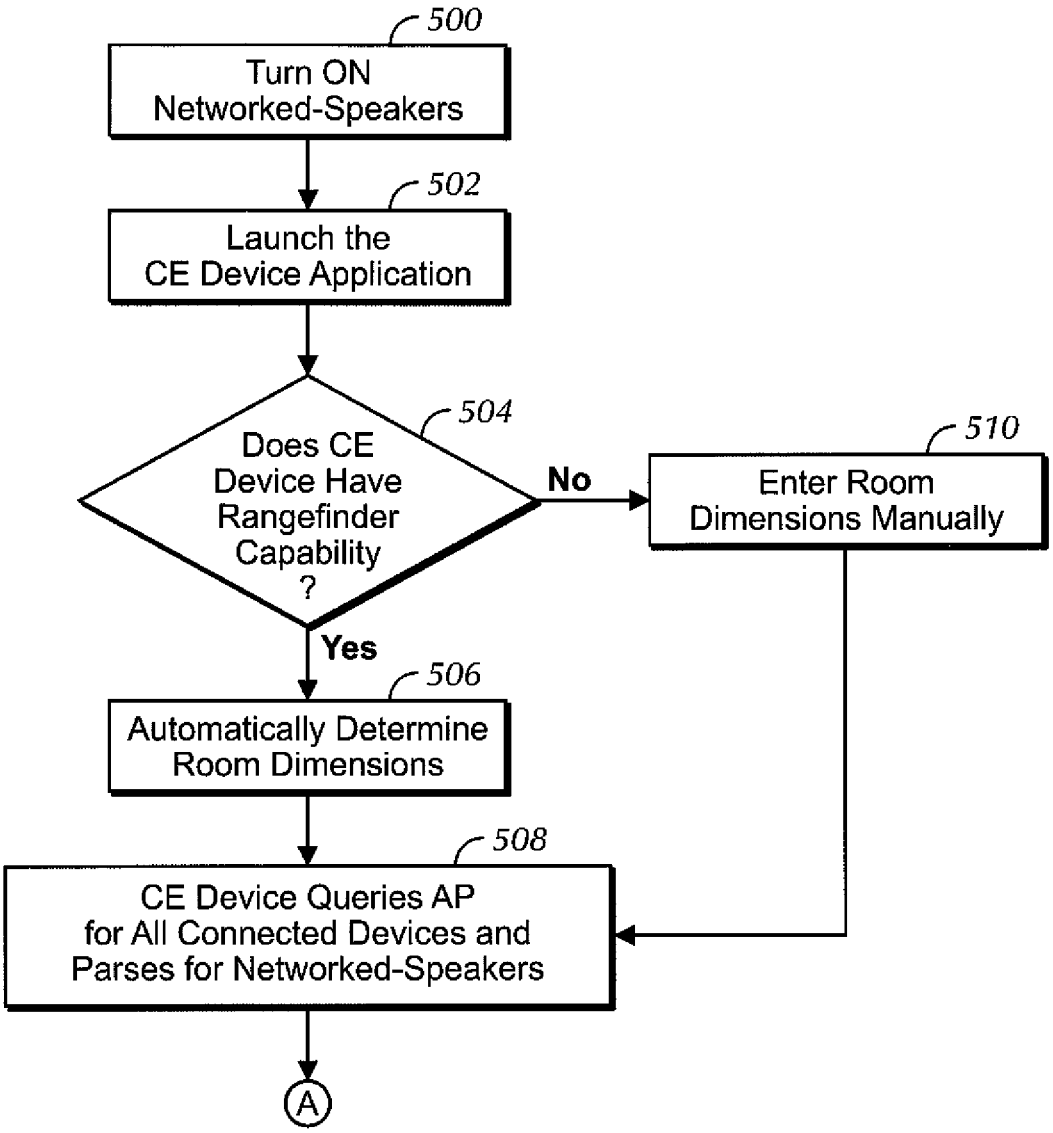
Figure 2B:
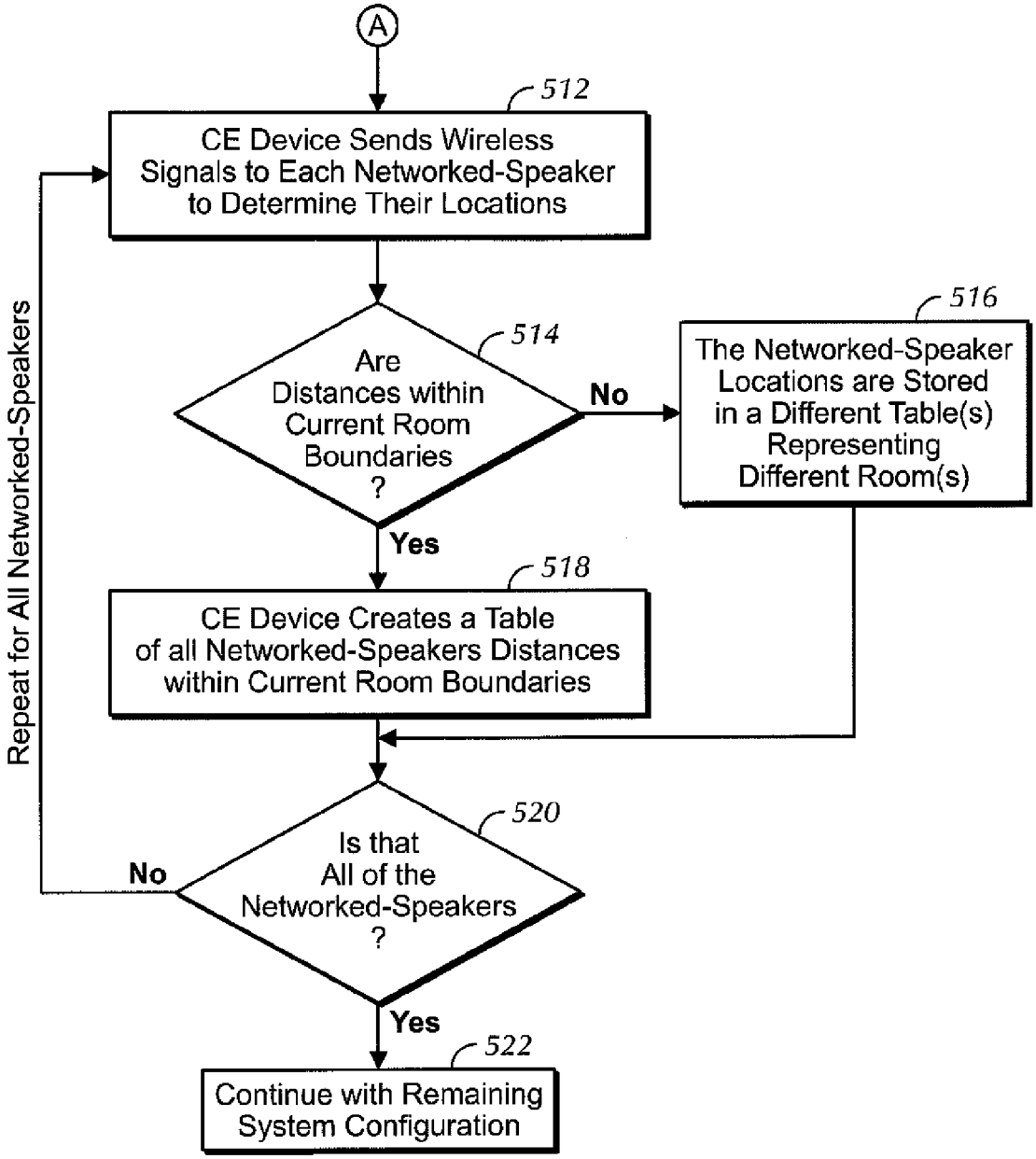

Now referring to FIGS. 2, 2A, 2B, flow charts of example logic is shown. The logic shown in the flow charts may be executed by one or more of the CPU 50, the CE device 12 processor 24, and the server 60 processor 62. The logic may be executed at application boot time when a user, e.g. by means of the CE device 12, launches a control application.

Of particular focus herein is the reproduction of low (bass) frequencies within the enclosure 70. At block 90 of FIG. 2, the characteristics of the speaker system (as, e.g., reported by the speakers over the network) and the locations of the speakers within a room (as input by a user or derived from GPS location reports from the individual speakers) are obtained, and then one or more of the following techniques may be applied to render low (bass) frequencies. At block 92, Equalization (EQ) variations (altering the frequency response of a speaker typically using linear filters) may be modeled to model a boost the output of each speaker at the low frequency corresponding to its minimum cone excursion (excursion being the distance the cone of a speaker linearly travels from its resting position), which is related to the resonance of the transducer and enclosure system. Any one or more of parametric, semi-parametric, graphic, peak, and program equalization may be used. Other speaker configuration parameters may be held constant as each successive EQ variation is applied to each individual speaker in turn to produce various modeled combinations of speakers among which low (bass) frequencies are distributed by, e.g., assigning one portion of the low (bass) frequency band to one speaker and another portion of the low (bass) frequency band to a second speaker, or by assigning the entire low (bass) frequency band to multiple speakers, or other low (bass) frequency assignation paradigm. Wave analysis is modeled as described above for each iteration and compared against the evaluation rules to determine at decision diamond 94 whether the model under test results in a satisfactory low (bass) frequency performance.

If a combination of speaker EQs results in passing a "good" low (bass) frequency configuration test, the EQs may be automatically established at block 96 for the respective speakers by separately addressing each speaker assembly using its network ID to command the individual speaker assemblies to set their EQs to the modeled EQs. On the other hand, if no variation of speaker EQs produces an acceptable low (bass) frequency performance, the logic may flow from decision diamond 94 to block 98.

At block 98, multiple combinations of speaker locations may be modeled as described above to attempt to obtain an optimal (i.e., satisfying a test) coupling of the speaker/room system to take advantage of the acoustical gain in the low (bass) frequency range provided by corners in the room. If speakers with different characteristics are used, the low frequency performance of each can be optimized, and furthermore, the optimization can account for the best balance that can be achieved by the combination of the speakers. A speaker that can reproduce lower frequencies than the others is tasked to do so, while frequencies the other speakers can reproduce are limited to that speaker, optimizing its performance. The system as a whole, thereby reproduces the best low frequency performance possible. A "good" (or the "best" one of multiple "good" location combinations) as determined at decision diamond 100 may be output at block 102, essentially as a suggestion of a modified speaker configuration based on the detected speaker positions. This suggestion may appear as a prompt on, e.g., the CE device display 14.

It is to be understood at this point that the suggested modifications alluded to above are generated as described previously using acoustic wave interference analysis. Thus, for example, the analysis typically may be undertaken using the location of the speakers and then multiple alternate configurations automatically computationally constructed and analyzed according to principles above using the analysis rules in effect and compared to the analysis results appertaining to the new speaker location to render one or more suggestions of "better" low (bass) frequency configurations by which to modify the speaker layout. These suggestions may be presented on the display 14 of the CE device 12 according to further description below.

In an example implementation and as discussed further below, one or more measurement microphones can be used to measure and adjust the frequency response of the system and identify the characteristics of the room, aiding in the optimization. Room correction can be implemented by using measurements and the known characteristics of each speaker. Based on its placement, one speaker may excite a room mode. The frequency response and impulse response of the speaker can be adjusted to compensate.

As recognized herein, with multi-channel and multi-room systems, different speakers often have different capabilities. Using present principles, the performance of the system is improved by utilizing the characteristics of each speaker and the room. This allows for optimization beyond the capabilities of existing systems.

Combining multiple speakers to collectively emit low (bass) frequencies may result in increased sound pressure levels; however, the increase can be optimized in the time and frequency domains. Speakers can be combined or stacked vertically and/or horizontally (with modeling of speaker locations in the flow charts accounting for each such possible location combination). The acoustic output can be optimized by altering the crossover alignment and EQ, which typically not adjustable on the fly in existing systems. In a flexible system, this becomes desirable. By "crossover alignment" is meant delaying the sound emanating from one or more drivers of a speaker to correct the tilting of lobes at the crossover frequenc(ies), with a crossover frequency being the dividing line between a higher frequency driver and a lower frequency driver.

To determine speaker location, position information may be received from each speaker 40 as sensed by a global positioning satellite (GPS) receiver on the speaker, or as determined using WiFi (via the speaker's MAC address, WiFi signal strength, triangulation, etc. using a WiFi transmitter associated with each speaker location, which may be mounted on the respective speaker) to determine speaker location. Or, the speaker location may be input by the user as discussed further below.

As stated above, each variable of the speaker configuration (location and/or frequency assignation and/or speaker parameter) may be varied individually and incrementally to establish a series of models each of which is tested against the rules to determine whether the configuration under test is "good". A large number of models may be incrementally generated and evaluated in this way. In one example, the new speaker locations and frequency assignations are held constant, and speaker delays and/or EQs varied incrementally, with each combination of incremental speaker delays/EQs establishing a configuration that is evaluated until all delay increment combinations have been tested. If any configuration thus evaluated produces a "good" configuration, meaning that by simply establishing speaker delays/EQs, the user's choice of speaker location can be accommodated, an indication of that configuration may be output on the CE device 12 and/or the delays automatically established in the respective speakers 40 by separately addressing each speaker as described above. If no configuration thus evaluated produces a "good" configuration, the algorithm may next calculate models for each possible combination of frequency assignations to the various speakers 40, again holding the new speaker locations constant in the modeling. If any configuration thus evaluated by testing different frequency assignations produces a "good" configuration, meaning that by simply establishing speaker frequency assignations, the user's choice of speaker location can be accommodated, an indication of that configuration may be output on the CE device 12 and/or the frequency assignations automatically established in the respective speakers 40 by sending the assigned frequencies to the respective speakers. In this non-limiting example, only if a "good" low (bass) frequency configuration cannot be established by varying speaker parameters or frequency variations are different speaker locations then modeled to obtain a "good" speaker configuration.

As mentioned above, if measurement microphones are available, the logic may optionally move to blocks 104 and 106 to guide the user through a measurement routine. An example UI to this end is discussed further below. In one example, the user is guided to cause each individual speaker in the system to emit a test sound ("chirp" frequency sweep) that the microphones 80 and/or microphone 18 of the CE device 12 detect and provide representative signals thereof to the processor or processors executing the logic, which, based on the test chirps, can adjust speaker parameters such as EQ, delays, and volume at block 106. Note that the test chirps and echoes thereof in some examples are used to establish the boundaries of the enclosure 70 for wave interference analysis purposes discussed above. This may be done as discussed previously.

From block 106 the logic may move to decision diamond 108 to determine whether any speaker is to be used for multiple spaces, i.e., used to supply audio in at least one space other than the enclosure 70. This may be determined based on user input from a UI, an example of which is described further below. If no further spaces are desired for speaker use, the logic exits and launches, e.g., on the CE device 12, a speaker control interface. However, if the user indicates that one or more speakers are to be used to also, in addition to the enclosure 70, send audio into adjoining spaces, the logic moves to block 110 to guide the user through secondary assignments for the speakers using, e.g., one or more UIs similar to the ones shown in FIGS. 4-7, 9, and 10 and discussed further below. From block 110 the logic exits and launches, e.g., on the CE device 12, the speaker control interface.

Figure 3:
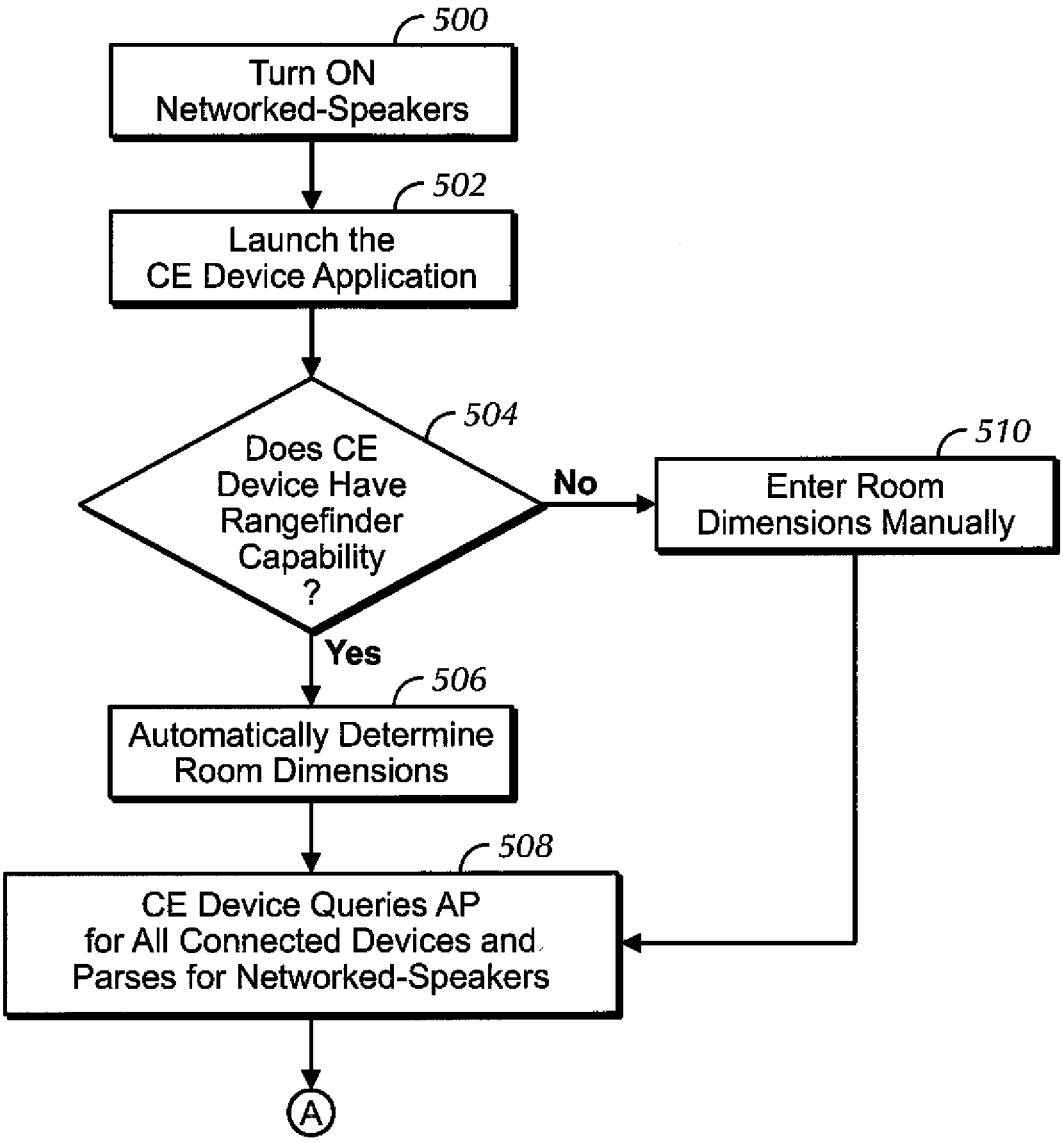
Figure 3A:
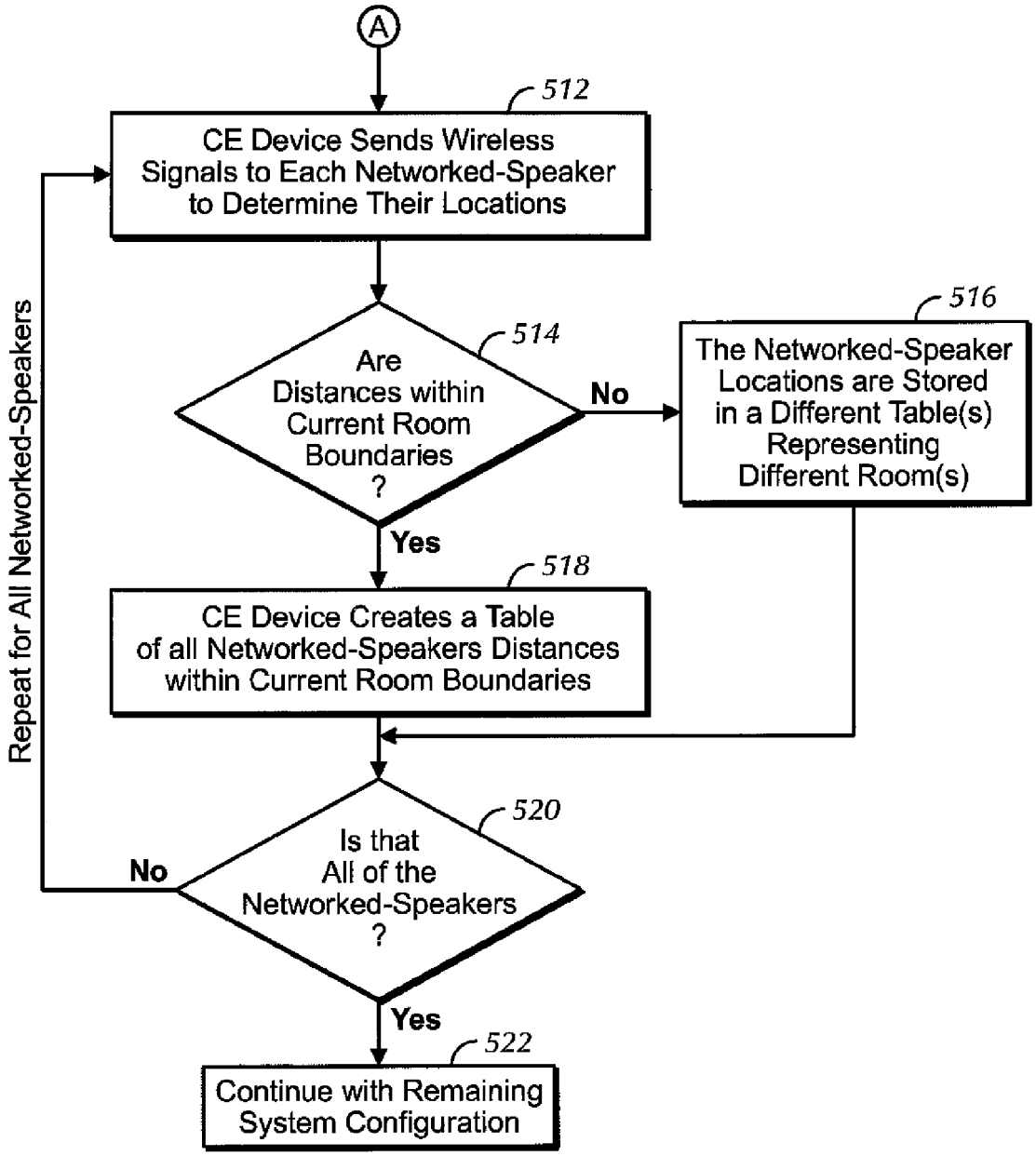

FIGS. 3 and 3A illustrate supplemental logic in addition to or in lieu of some of the logic disclosed elsewhere herein that may be employed in example non-limiting embodiments to discover and map speaker location and room (enclosure 70) boundaries. Commencing at block 500, the speakers are energized and a discovery application for executing the example logic below is launched on the CE device 12. If the CE device 12 has range finding capability at decision diamond 504, the CE device (assuming it is located in the enclosure) automatically determines the dimensions of the enclosure in which the speakers are located relative to the current location of the CE device 12 as indicated by, e.g., the GPS receiver of the CE device. Thus, not only the contours but the physical locations of the walls of the enclosure are determined. This may be executed by, for example, sending measurement waves (sonic or radio/IR) from an appropriate transceiver on the CE device 12 and detecting returned reflections from the walls of the enclosure, determining the distances between transmitted and received waves to be one half the time between transmission and reception times the speed of the relevant wave. Or, it may be executed using other principles such as imaging the walls and then using image recognition principles to convert the images into an electronic map of the enclosure.

From block 506 the logic moves to block 508, wherein the CE device queries the speakers, e.g., through a local network access point (AP), by querying for all devices on the local network to report their presence and identities, parsing the respondents to retain for present purposes only networked audio speakers. On the other hand, if the CE device does not have rangefinding capability the logic moves to block 510 to prompt the user of the CE device to enter the room dimensions.

From either block 508 or block 510 the logic flows to block 512, wherein the CE device 12 sends, e.g., wirelessly via Bluetooth, WiFi, or other wireless link a command for the speakers to report their locations. These locations may be obtained by each speaker, for example, from a local GPS receiver on the speaker, or a triangulation routine may be coordinated between the speakers and CE device 12 using ultra wide band (UWB) principles. UWB location techniques may be used, e.g., the techniques available from DecaWave of Ireland, to determine the locations of the speakers in the room. Some details of this technique are described in Decawave's USPP 20120120874, incorporated herein by reference. Essentially, UWB tags, in the present case mounted on the individual speaker housings, communicate via UWB with one or more UWB readers, in the present context, mounted on the CE device 12 or on network access points (APs) that in turn communicate with the CE device 12. Other techniques may be used.

The logic moves from block 512 to decision diamond 514, wherein it is determined, for each speaker, whether its location is within the enclosure boundaries determined at block 506. For speakers not located in the enclosure the logic moves to block 516 to store the identity and location of that speaker in a data structure that is separate from the data structure used at block 518 to record the identities and IDs of the speakers determined at decision diamond 514 to be within the enclosure. Each speaker location is determined by looping from decision diamond 520 back to block 512, and when no further speakers remain to be tested, the logic concludes at block 522 by continuing with any remaining system configuration tasks divulged herein.

Figure 4:
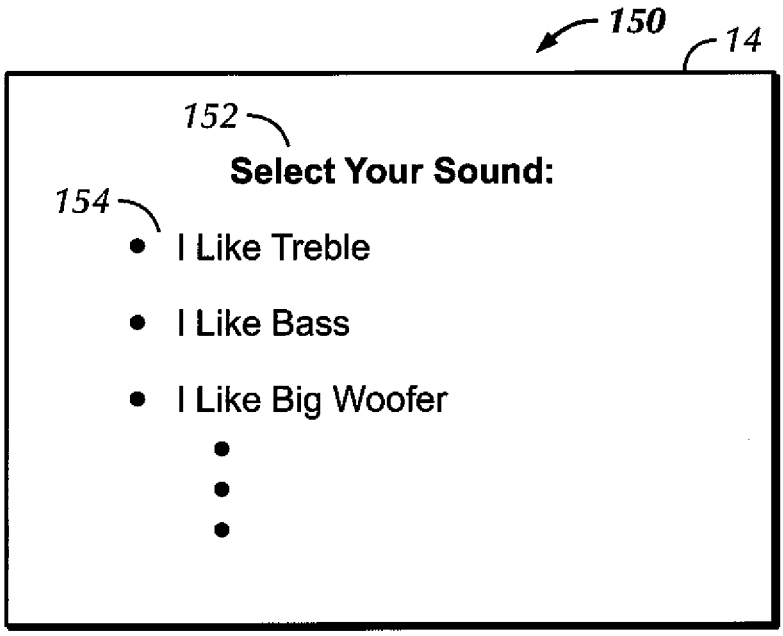
FIGS. 4-12 are example user interfaces (UI) according to present principles.

FIG. 4 shows an example UI 150 that may be presented on the display 14 of the CE device 12 as alluded to in the discussion of analysis rules. A user may be prompted at 152 to select a particular preferred sound from a list 154 of sounds, or may be prompted to adjust the desired frequency response by dragging one or more points each of which can be altered in frequency and amplitude, positive or negative, to create a customized EQ curve. In the example shown, the user may indicate that more, rather than less, bass is desired, and this becomes an analysis rule during the waveform analysis discussed above, in which configurations producing the most average or mean constructive interference in the bass range are output as "good" over configurations producing less constructive interference in the bass range. In the example shown, the user may indicate that more, rather than less, low (bass) frequency (deep bass) is desired, and this becomes an analysis rule during the waveform analysis discussed above, in which configurations producing the most average or mean constructive interference in the woofer range are output as "good" over configurations producing less constructive interference in the woofer range.

Figure 5:
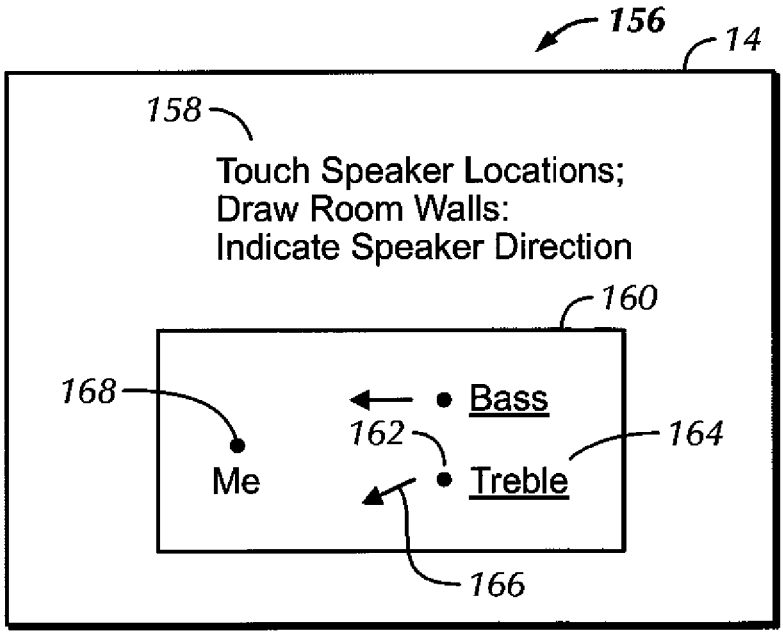

FIG. 5 shows an example UI 156 that may be presented on the CE device 12 according to discussion above. The user is prompted 158 to touch speaker locations and trace as by a finger or stylus the enclosure 70 walls, and further to name speakers and indicate a target listener location. Accordingly, the user has, in the example shown, drawn at 160 the enclosure 70 boundaries and touched at 162 the speaker locations in the enclosure. At 164 the speaker has input speaker names of the respective speakers, in this case also defining the frequency assignation desired for each speaker. At 166 the user has traced the direction of the sonic axis of each speaker, thereby defining the orientation of the speaker in the enclosure. At 168 the user has touched the location corresponding to a desired target listener location. These inputs are then used in the logic of FIG. 2 when executing the various waveform interference-based steps.

Figure 6:
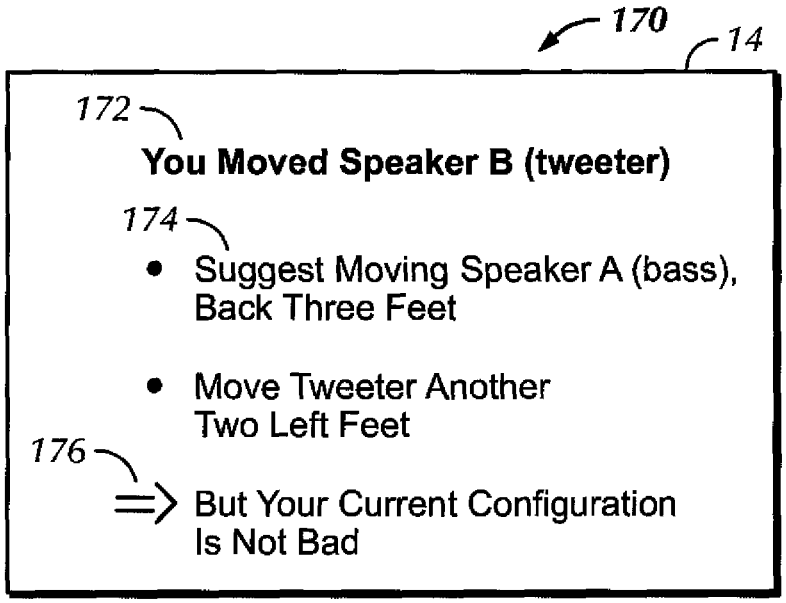

FIG. 6 shows an example UI 170 that may be presented on the CE device 12 according to discussion above. A message 172 may be presented confirming to the user that he moved one or more speakers with one or more suggestions 174 presented regarding how to further optimize the speaker set up. A comment 176 may also be provided (if appropriate based on the waveform analysis) as to the qualitative evaluation of the user's new setup without following any of the suggestions 174. The quality may be based on the points alluded to above, e.g., for 2-4 rule-based points the configuration may be evaluated as "not bad", for >4 the evaluation may be "good", and for <2 the evaluation may be "not good" or "poor".

Figure 7:
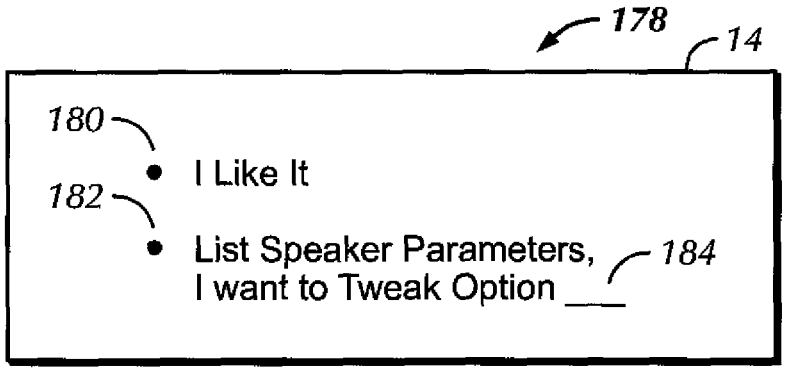
Figure 8:
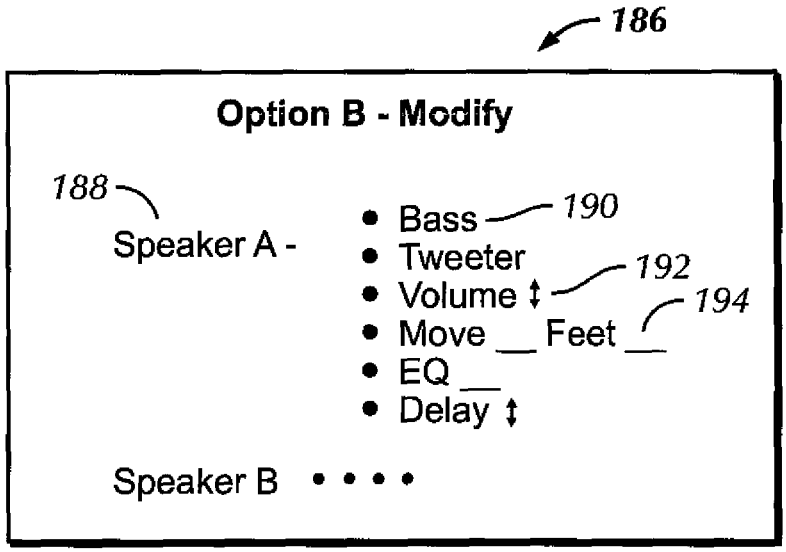

FIG. 7 shows an example UI 178 that may be presented on the CE device 12 according to discussion above. The user may indicate at 180 that the current configuration is satisfactory (by, e.g., touching the display 14) or the user may indicate at 182 to list speaker parameters for a given one of the options 174 shown in FIG. 6. In this latter case a list of speaker parameters and/or positions and/or frequency assignations may be provided on another UI for the user to adjust individual settings accordingly. FIG. 8 shows an example of such as UI 186 that may be presented on the CE device 12. As indicated in FIG. 8, the user has chosen, as the target suggestion to modify, option B (the second option) shown in FIG. 7, with a list 188 of speakers and respective parameters 190 associated with each speaker that may be adjusted in the user appropriately manipulating up/down selector elements 192 and/or appropriately entering values into fields 194 indicating, for example, EQ levels, a direction and distance in which the respective speaker is sought to be moved, etc.

Figure 9:
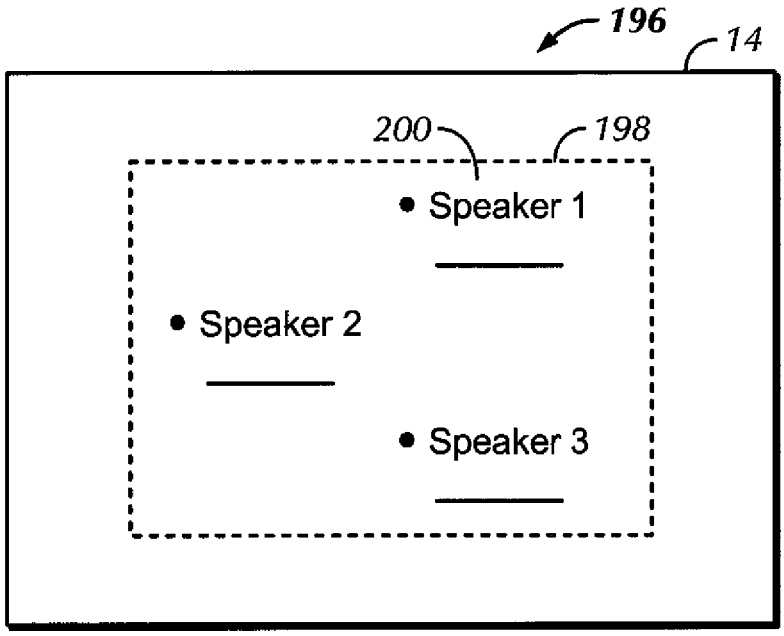

FIG. 9 shows an example UI 196 that may be presented on the CE device 12 according to discussion above. As shown at 198, the boundary of the enclosure 70, determined according to one or more of the methods previously described, is presented on the display 14 along with locations 200 of the speakers, also determined according to previous disclosure. Fields are provided next to each generic speaker name into which a user can enter a user-defined speaker name, e.g., front left, subwoofer, center channel, etc. In these latter cases the user-defined names may not only be presented next to the respective speakers in subsequently presented Ms, but may also be used by the processor executing the logic to assign frequency bands to the speakers s designated, based on word recognition of the user-defined names.

Figure 10:
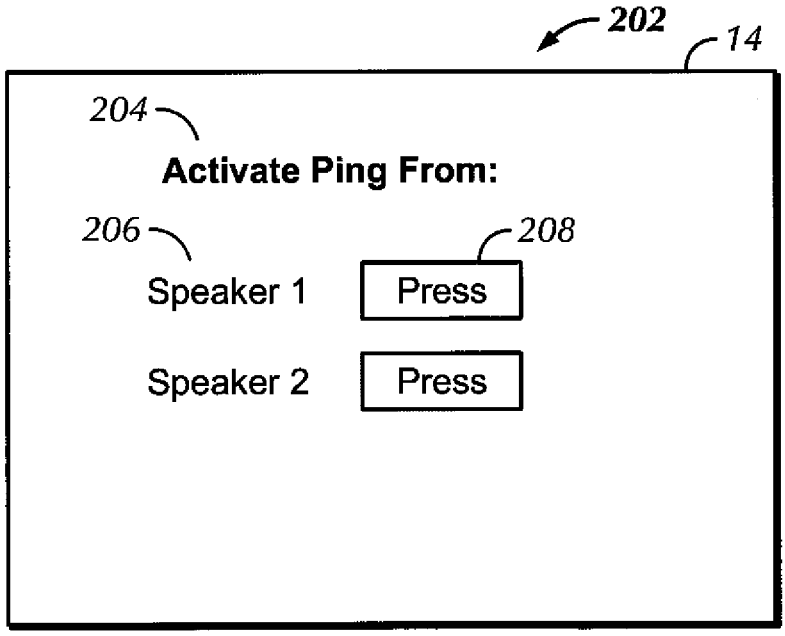

FIG. 10 shows an example UI 202 that may be presented on the CE device 12 according to discussion above related to state 104. The user is prompted 204 to activate a chirp from each speaker in a list 206 of speakers by selecting a respective chirp selector element 208, causing the respective speaker to emit a test chirp according to discussion above.

Figure 11:
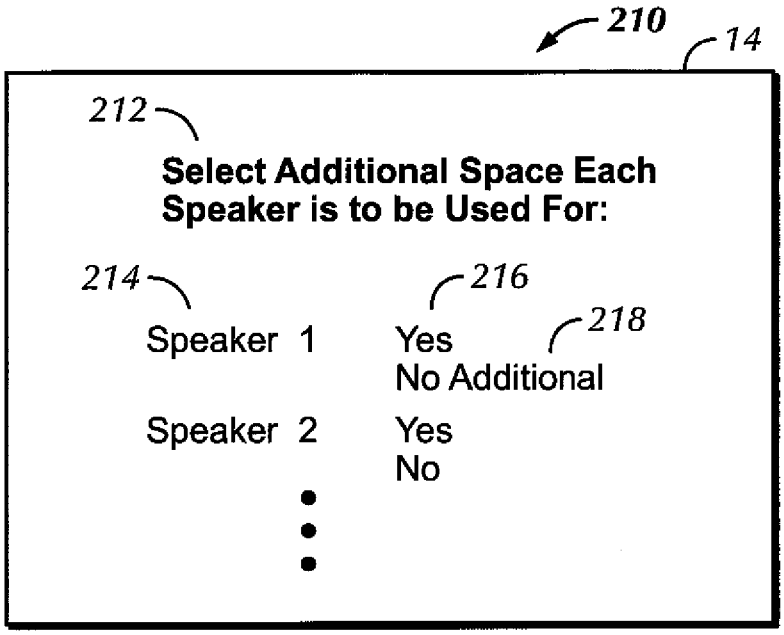

FIG. 11 shows an example UI 210 that may be presented on the CE device 12 according to discussion above related to state 108. The user is prompted 212 to select an additional space a speaker selected from a list 214 of speakers is to be used for. For each speaker in the list 214 the user may select 216 that the speaker will be used for an additional space, or the user may select a selector element 218 indicating that the speaker will be used for no additional spaces in addition to the enclosure 70.

Figure 12:
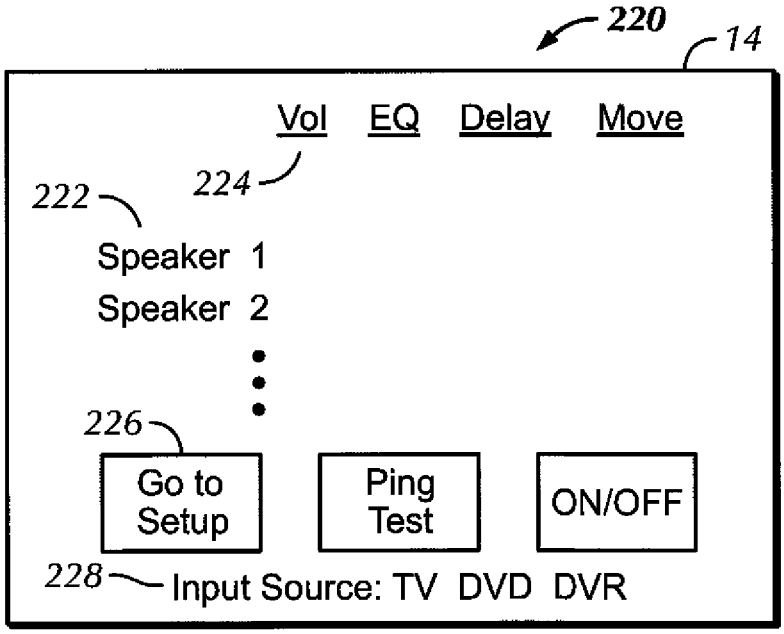

FIG. 12 shows an example speaker control interface UI 220 that may be presented on the CE device 12 according to discussion above related to ending the setup logic and transitioning into speaker control during operation of the audio system. The example non-limiting UI 220 may present a list 222 of speakers in the system and, in a row, a list 224 of speaker parameters for each speaker, for adjustment thereof by the user if desired. A setup selector element 226 may be provided selectable to allow the user to invoke the logic of the flow charts. Other selector elements may be provided to, e.g., initiate the chirp test of the flow charts and to toggle the audio system on and off. An input source selector 228 may be provided to select the source of audio input to the audio system, e.g., a TV source, a video disk source, a personal video recorder source.

A Wi-Fi or network connection to the server 60 from the CE device 12 and/or CPU 50 may be provided to enable updates or acquisition of the control application. The application may be vended or otherwise included or recommended with audio products to aid the user in achieving the best system performance. An application (e.g., via Android, iOS, or URL) can be provided to the customer for use on the CE device 12. The user initiates the application, answers the questions/prompts above, and receives recommendations as a result. Parameters such as EQ and time alignment may be updated automatically via the network.

While the particular WIRELESS SPEAKER SYSTEM WITH DISTRIBUTED LOW (BASS) FREQUENCY is herein shown and described in detail, it is to be understood that the subject matter which is encompassed by the present invention is limited only by the claims.

What is claimed is:

1. A device comprising:

at least one computer memory that is not a transitory signal and that comprises instructions executable by at least one processor for:

accessing characteristics of plural speakers having respective locations within a space;

modeling multiple speaker configurations;

determining whether a modeled speaker configuration satisfies at least one low (bass) frequency criterion;

establishing the modeled speaker configuration at least in part by automatically setting speaker parameters including identifying individual speakers using respective network addresses, and/or by outputting a suggested configuration to a user, the suggested configuration including at least one suggested speaker location; and modeling plural equalization of at least a first to model respective boots of an output of the first speaker at a frequency corresponding to a minimum cone excursion of the first speaker.

2. The device of claim 1, wherein the instructions are executable for establishing the modeled speaker configuration at least in part by automatically setting speaker parameters.

3. The device of claim 2, wherein the speaker parameters include equalization.

4. The device of claim 1, wherein the instructions are executable for establishing the modeled speaker configuration at least in part by outputting a suggested configuration to a user.

5. A device comprising:

at least one computer memory that is not a transitory signal and that comprises instructions executable by at least one processor for:

accessing characteristics of plural speakers having respective locations within a space;

determining whether a modeled speaker configuration satisfies at least one low (bass) frequency criterion:

establishing the modeled speaker configuration at least in part by automatically setting speaker parameters including identifying individual speakers using respective network addresses, and/or by outputting a suggested configuration to a user, the suggested configuration including at least one suggested speaker location, wherein the speaker parameters include equalization; and responsive to a determination that no modeled speaker equalization combination satisfies the at least one low (bass) frequency criterion, modeling plural candidate speaker locations in the space, and otherwise not modeling plural candidate speaker locations in the space.

6. The device of claim 1, wherein the instructions are executable for:

receiving at least one test signal from at least one measurement microphone; and using the test signal to determine a modeled speaker configuration.

7. Method comprising:

accessing characteristics of a multi-speaker system;

modeling multiple speaker configurations of the system;

determining whether a modeled speaker configuration satisfies at least one low (bass) frequency criterion;

establishing the modeled speaker configuration at least in part responsive to a determination that the modeled speaker configuration satisfies the at least one low (bass) frequency criterion, wherein the speaker parameters include equalization; and responsive to a determination that no modeled speaker equalization combination satisfies the at least one low (bass) frequency criterion, modeling plural candidate speaker locations in the space and otherwise not modeling plural candidate speaker locations in the space.

8. The method of claim 7, wherein the modeled speaker configuration is established at least in part by automatically setting speaker parameters.

9. The device of claim 1, comprising the at least one processor.

10. The method of claim 7, wherein the modeled speaker configuration is established at least in part by outputting a suggested configuration to a user.

11. Method comprising:

accessing characteristics of a multi-speaker system;

modeling multiple speaker configurations of the system;

determining whether a modeled speaker configuration satisfies at least one low (bass) frequency criterion;

establishing the modeled speaker configuration at least in part responsive to a determination that the modeled speaker configuration satisfies the at least one low (bass) frequency criterion; and modeling plural equalizations of at least a first speaker to model respective boosts of an output of the first speaker at a frequency corresponding to a minimum cone excursion of the first speaker.

12. The method of claim 7, comprising:

receiving at least one test signal from at least one measurement microphone; and using the test signal to determine a modeled speaker configuration.

13. System comprising:

at least one computer readable storage medium bearing instruction executable by as processor Which is configured for accessing the computer readable storage medium to execute the instructions to configure the processor for:

controlling a speaker system comprised of more than one speaker;

using characteristics and locations of each speaker to enhance low (bass) frequency performance of the system at least in part by distributing low (bass) frequencies among plural speakers; and modeling plural equations of at least a speaker to model respective boosts of an output of the first speaker at a frequency corresponding to a minimum cone excursion of the first speaker.

14. The system of claim 13, wherein the the intructions configure the processor for executing the act of using by configuring the processor for:

accessing characteristics of plural speakers having respective locations within a space;

modeling multiple speaker configurations;

determining whether a modeled speaker configuration satisfies at least one low (bass) frequency criterion; and establishing the modeled speaker configuration at least in part by automatically setting speaker parameters including identifying individual speakers using respective network addresses, and/or by outputting a suggested configuration to a user, the suggested configuration including at least one suggested speaker location.

15. The system of claim 14, wherein the modeled speaker configuration is established by the processor when executing the instructions at least in part by automatically setting speaker parameters.

16. The system of claim 15, wherein the speaker parameters include equalization.

17. The system of claim 14, wherein the modeled speaker configuration is established by the processor when executing the instructions at least in part by outputting a suggested configuration to a user.

* * * * *